US007250583B2

(12) United States Patent
Cameroni et al.

(10) Patent No.: US 7,250,583 B2
(45) Date of Patent: Jul. 31, 2007

(54) GAS-INSULATED SWITCHGEAR DEVICE

(75) Inventors: Roberto Cameroni, Milan (IT); Libero Sfondrini, Lodi (IT); Vittorio Gargioni, Montanaso Lombardo (IT)

(73) Assignee: ABB Technology AG, Zurich (CH)

( * ) Notice: Subject to any disclaimer, the term of this patent is extended or adjusted under 35 U.S.C. 154(b) by 0 days.

(21) Appl. No.: 11/108,117

(22) Filed: Apr. 18, 2005

(65) Prior Publication Data

US 2005/0236371 A1 Oct. 27, 2005

(30) Foreign Application Priority Data

Apr. 19, 2004 (EP) ..... 04076123

(51) Int. Cl.
*H01H 33/14* (2006.01)

(52) U.S. Cl. ..... 218/7; 218/14; 218/154

(58) Field of Classification Search ..... 218/2, 218/4, 7, 12–14, 43–45, 78, 140, 153, 154
See application file for complete search history.

(56) References Cited

U.S. PATENT DOCUMENTS

| | | | | |
|---|---|---|---|---|
| 5,796,060 | A | 8/1998 | Füchsle et al. | |
| 6,444,937 | B1 | 9/2002 | Piazza | |
| 6,545,241 | B1 | 4/2003 | Franchi et al. | |
| 6,573,469 | B1 | 6/2003 | Piazza | |
| 6,680,453 | B2 * | 1/2004 | Rokunohe et al. | 218/2 |
| 6,683,267 | B1 | 1/2004 | Piazza et al. | |
| 6,759,616 | B2 * | 7/2004 | Rokunohe et al. | 218/2 |
| 6,784,392 | B1 | 8/2004 | Piazza et al. | |

FOREIGN PATENT DOCUMENTS

| | | |
|---|---|---|
| EP | 1 214 765 | 3/2001 |
| EP | 1 214 768 B1 | 6/2002 |

* cited by examiner

*Primary Examiner*—Elvin Enad
(74) *Attorney, Agent, or Firm*—Buchanan Ingersoll & Rooney PC

(57) ABSTRACT

A gas-insulated switchgear device comprising a first casing housing: at least a first terminal for input/output connection; a disconnector unit comprising at least a first fixed contact operatively coupled to said first terminal and a corresponding first movable contact which can be electrically connected/disconnected with said first fixed contact, during operation of the disconnector unit; a circuit breaker unit electrically connected to said disconnector unit and comprising at least a couple of interruption contacts which can be actuated, during operation of said circuit breaker unit, between a circuit breaker closed position where they are electrically coupled and a circuit breaker open position where they are electrically separated; actuating means for operating said disconnector unit and said circuit breaker unit; a second casing operatively coupled with said actuating means, which houses said interruption contacts and on the outer surface of which at least said first movable contact is mounted; characterized in that said second casing is pivotally mounted inside said first casing so as to rotate said first movable contact during operation of said disconnector unit, said couple of interruption contacts being operatively coupled to said actuating means so as to be kept electrically coupled in said circuit breaker closed position and substantially still relative to each other during rotation of said second casing.

17 Claims, 4 Drawing Sheets

GAS-INSULATED SWITCHGEAR DEVICE

CROSS REFERENCE TO RELATED APPLICATIONS

This application claims priority under 35 U.S.C. §119 to European Application 04076123.1 filed with European Patent Office on 19 Apr. 2004, the entire contents of which are hereby incorporated by reference in their entireties.

FIELD

The present invention relates to a gas-insulated switchgear device for high- or medium-voltage applications, i.e. for voltages above 1000V.

BACKGROUND INFORMATION

It is well known in the art that along the path of a power grid there are provided several electric substations for transmitting and distributing electricity from a power generating source to loads and users connected to the feeding grid; these substations may be configured according to different layouts depending on the applications, for example in/out or T-type layouts, H-type layouts et cetera, and are realized by using a series of electric components, such as disconnectors, circuit breakers, instrument transformers, control systems.

According to more traditional solutions, electric substations have been realized by using several components which are structurally independent and suitably connected to each other and to the power line when assembling in order to obtain the required layout and to perform each a respective dedicated function; these traditional solutions have presented some drawbacks in practical use, mainly due to the large number of components required, even for providing a minimal configuration, and to their structural and functional separation. Indeed, these aspects result in heavy maintenance requirements for each and any of the single components used, and to a considerable increase of the overall dimensions of the substation, with a consequent negative impact on installation and maintenance costs, as well as on environmental impact.

To overcome the above mentioned drawbacks, in recent years some new compact gas-insulated switchgear devices have been designed, which integrate in a unique apparatus and are able to perform several electrical functions which, in the more traditional substations, were obtained by using multiple structurally separate elements.

In particular, such devices comprise an external casing having a pod-shaped portion on which there are mounted two or three bushings each containing a corresponding electric terminal for input/output connections with a power line and/or other elements of the substation; inside the pod-shaped portion there are normally provided at least a disconnection unit and an interruption unit, which are suitably conceived and electrically connected to each other and to the electric terminals, in such a way to perform electrical disconnection or circuit breaker maneuvers, respectively.

Examples of such kinds of gas-insulated switchgear devices are disclosed in the international patent application Ser. No. WO0024099 and U.S. Pat. No. 5,796,060.

This type of switchgear devices has significantly contributed to reduce the number of components needed, thus allowing to realize more compact substations with less environmental visual impact, and installation and maintenance costs reduced; nonetheless, these devices still present some aspects which may be further improved as regard to their structure, flexibility in the number of electrical maneuvers which can be executed, especially with respect to the number of possible combinations and coordination of circuit breaker and disconnector operations, and the way to perform them too. For example, before operating the disconnector unit for disconnecting one or more of the input or output connections, it is usually necessary first to open the interruption unit thus breaking the current flow and therefore putting out of commission the whole device; this is not entirely satisfactory for example when the device has an input connection and two output connections only one of which should be disconnected e.g. for maintenance reasons, while the other connections with the loads connected could be kept working.

SUMMARY

Thus, the main aim of the present invention is to provide a high- or medium-voltage gas-insulated switchgear device of the above mentioned type having, with respect to known devices, a further improved functionality and an increased flexibility in terms of electrical operations which can be performed and coordinated, and of operating configurations which can be realized during practical use, with an optimised structure.

This aim is achieved by a gas-insulated switchgear device comprising a first casing housing: at least a first terminal for input/output connection; a disconnector unit comprising at least a first fixed contact operatively coupled to said first terminal and a corresponding first movable contact which can be electrically connected/disconnected with said first fixed contact, during operation of the disconnector unit; a circuit breaker unit electrically connected to said disconnector unit and comprising at least a couple of interruption contacts which can be actuated, during operation of said circuit breaker unit, between a circuit breaker closed position where they are electrically coupled and a circuit breaker open position where they are electrically separated; actuating means for operating said disconnector unit and said circuit breaker unit; a second casing operatively coupled with said actuating means, which houses said interruption contacts and on the outer surface of which at least said first movable contact is mounted; characterized in that said second casing is pivotally mounted inside said first casing so as to rotate said first movable contact during operation of said disconnector unit, said couple of interruption contacts being operatively coupled to said actuating means so as to be kept electrically coupled in said circuit breaker closed position and substantially still relative to each other during rotation of said second casing.

BRIEF DESCRIPTION OF THE DRAWINGS

Further characteristics and advantages of the device according to the present invention will become better apparent from the description of preferred but not exclusive embodiments of a switchgear device according to the invention, illustrated only by way of non-limitative example in the accompanying drawings, wherein.

DETAILED DESCRIPTION

Figure 4:
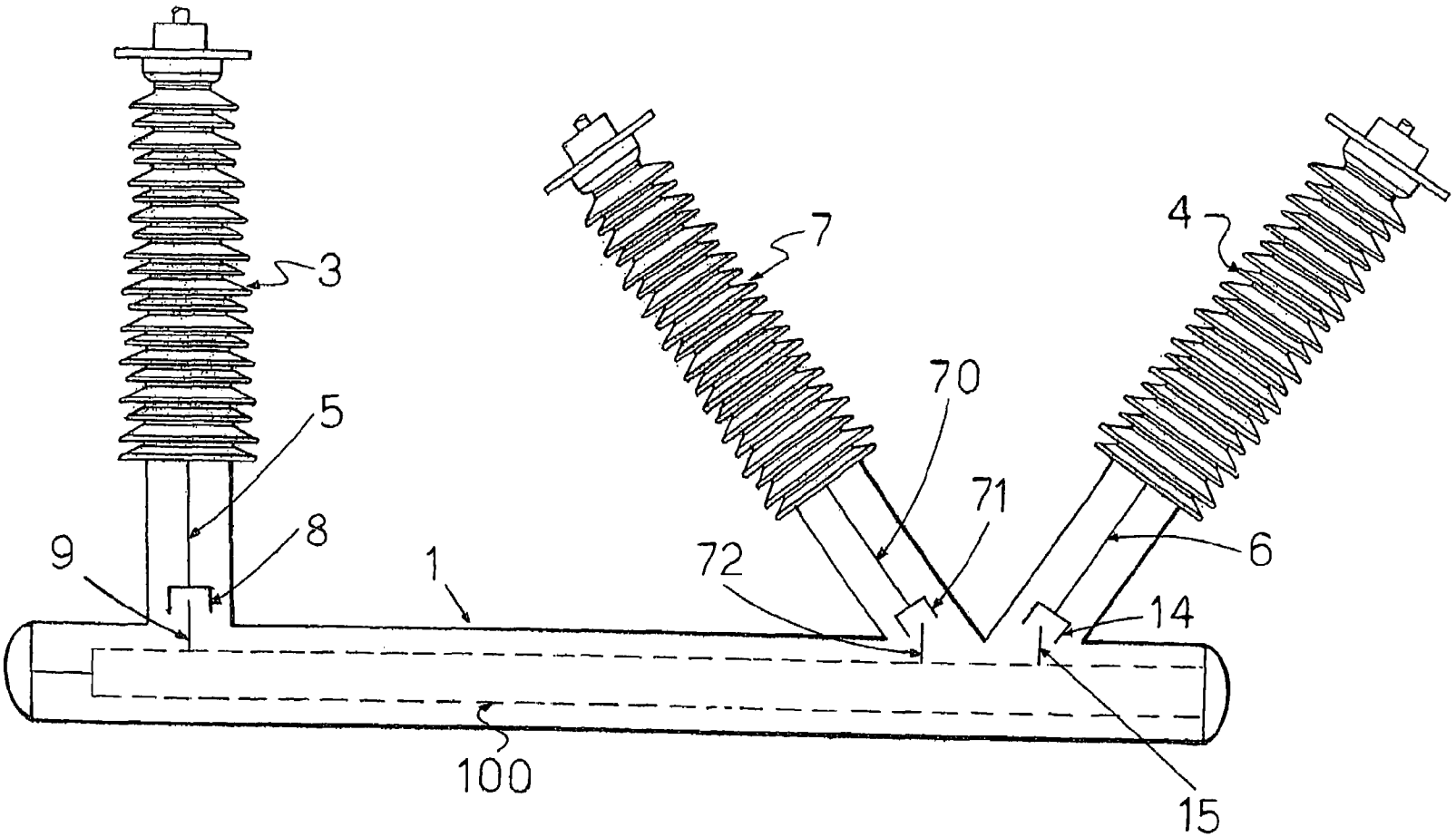
FIG. 4 is a view schematically illustrating a preferred embodiment of a switchgear device according to the invention.

With reference to the above cited figures, the high- or medium-voltage gas-insulated switchgear device according to the invention, comprises a first fixed casing 1 which is partially or totally filled with an electric insulating gas, e.g. $SF_6$, and has, in the embodiments illustrated, a pod-shaped portion 2 and one or more bushings mechanically mounted on the pod-shaped portion 2. Each bushing contains a corresponding electrical terminal or bar for input/output connections of the switchgear device with a power line and/or other components, such as transformers, loads, et cetera; in FIG. 1 there are illustrated only two bushings 3 and 4 housing two corresponding terminals 5 and 6, respectively. As schematically shown in FIG. 4, the casing 1 preferably comprises a third bushing 7 housing a corresponding third terminal 70.

The switchgear device according to the invention also comprises, positioned inside the casing 1, a disconnector unit having at least a first fixed contact 8 electrically coupled to the first terminal 5, and a corresponding first movable contact 9 which can be actuated, during operation of said disconnector unit, so as to electrically connect/disconnect with/from the first fixed contact 8; as illustrated, the disconnector unit comprises also a second fixed contact 14 electrically coupled to the second terminal 6 and a corresponding second movable contact 15. According to a preferred embodiment illustrated in FIG. 4, the disconnector unit comprises a third fixed contact 71 which is operatively connected to the corresponding third terminal 70; accordingly, the second movable contact 15 can be suitably arranged so as it can be electrically connected/disconnected also with/from the third fixed contact 71. Alternatively, as shown in FIG. 4, the disconnector unit comprises a third movable contact 72 which can be electrically connected/disconnected with/from the third fixed contact 71, while the second movable contact 15 connects/disconnects only with/from the corresponding second fixed contact 14. Finally, as shown in FIGS. 1 and 2, the disconnector unit may comprise one or more additional fixed contacts 4, directly mounted on the first casing 1 which is at ground potential; each contact 40 can be connected to a corresponding moving contact 9 or 15 or 72 so as to realize ground connections.

Figure 2:
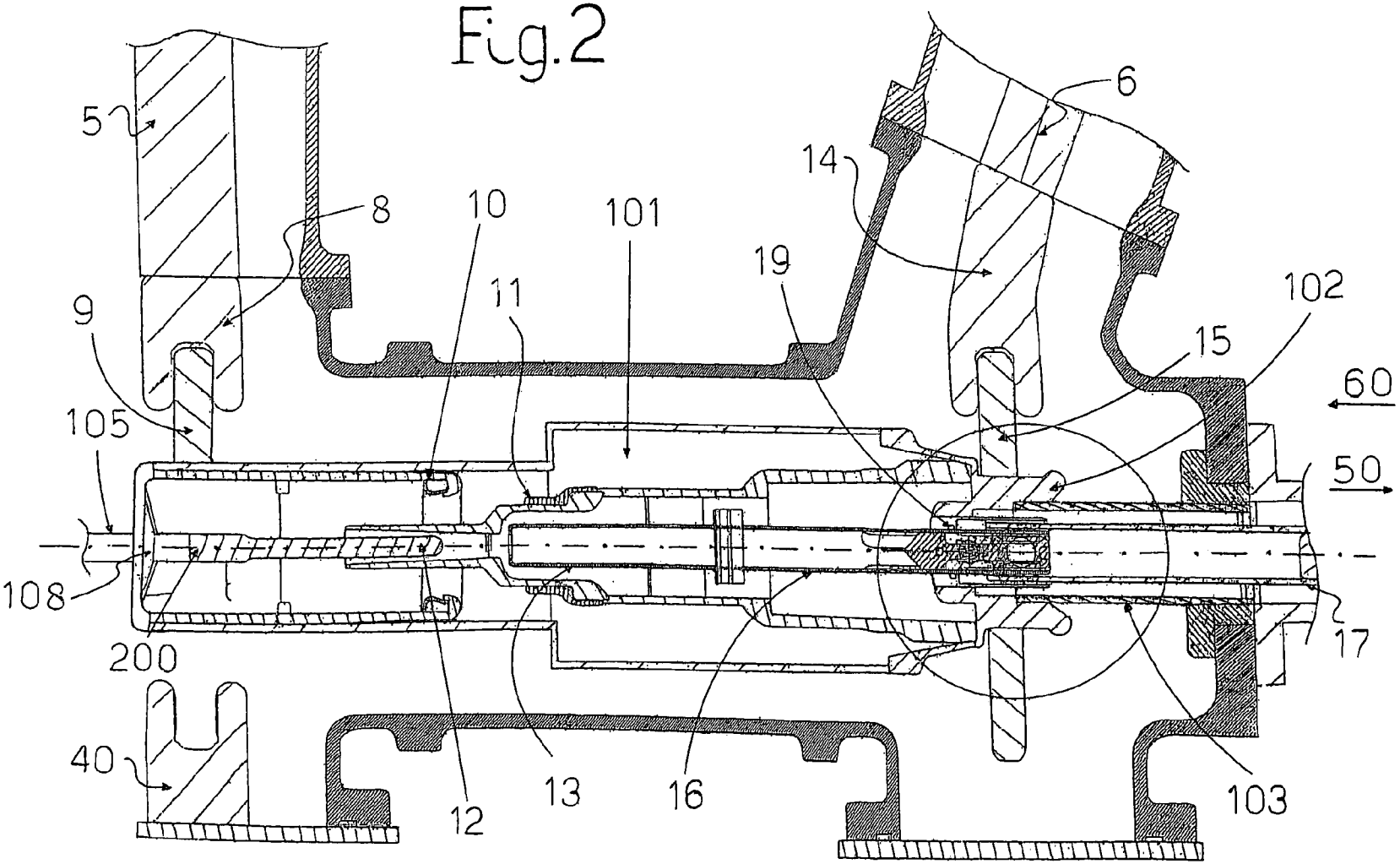
FIG. 2 is a partial cross-section view of the switchgear device of FIG. 1.

Inside the casing 1 there is also provided a circuit breaker unit which is electrically connected to the disconnector unit and comprises at least a couple of interruption contacts, i.e. a first main contact 10 and a second main contact 11 which can be actuated, during operation of the circuit breaker unit, between a circuit breaker closed position where they are electrically coupled and a circuit breaker open position, illustrated in FIG. 2, where they are electrically separated. The circuit breaker unit comprises also arcing contacts 12 and 13 whose structure and functions are well known in the art and therefore not described here in details.

Figure 1:
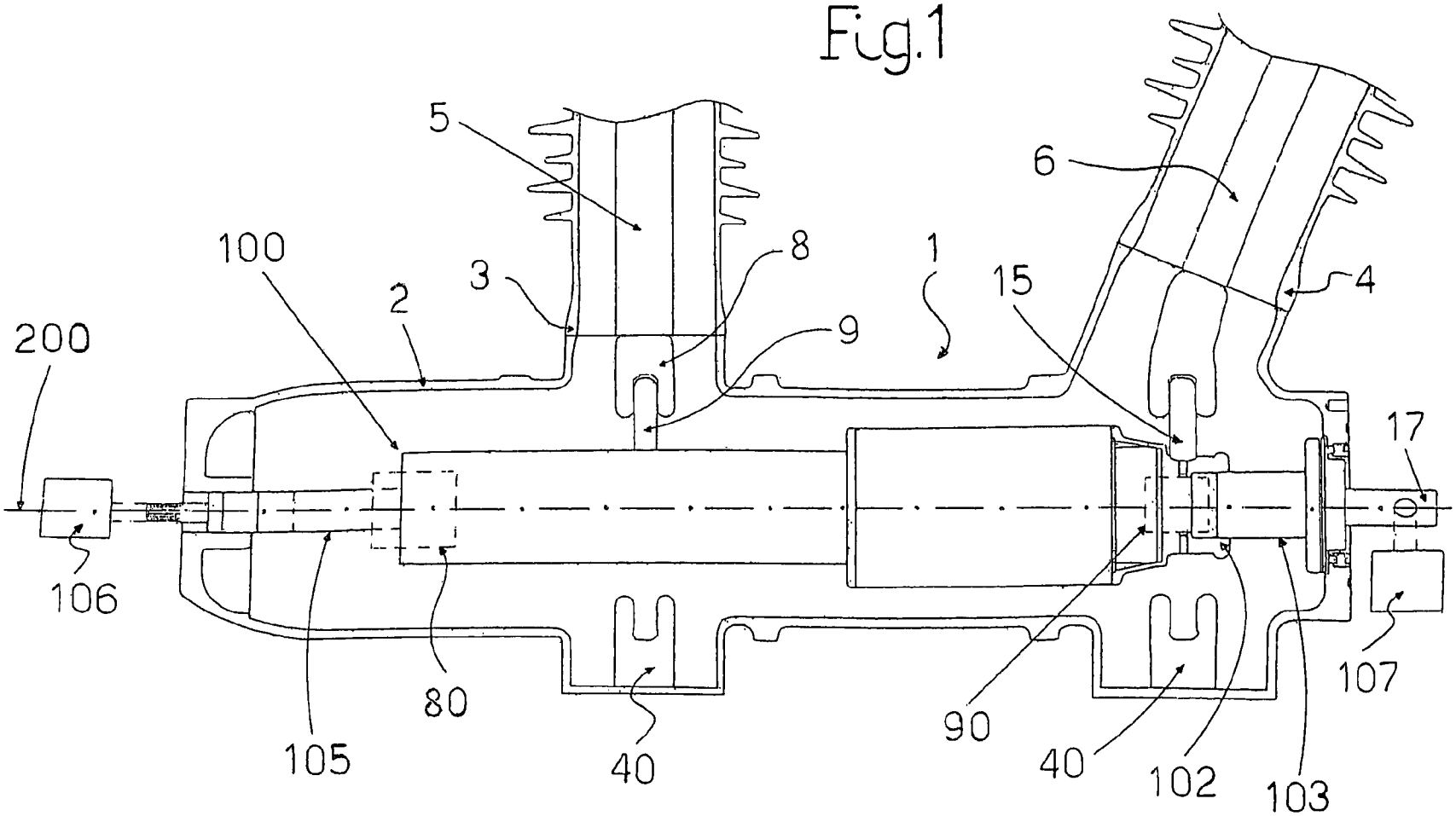
FIG. 1 is a side view illustrating a first embodiment of a switchgear device according to the invention.

Furthermore, there are provided: actuating means for operating the disconnection unit and the circuit breaker unit when executing electrical manoeuvres, e.g. opening/closing of the circuit breaker unit and/or connection/disconnection of the input/output connections; and a second casing unit, globally indicated in FIG. 1 by the reference number 100, which is operatively coupled with said actuating means, which houses the contacts of the circuit breaker unit and on the outer surface of which at least the first movable contact 9 is mounted. The second casing 100 is also filled with insulating gas, e.g. $SF_6$; alternatively, it is possible to fill with a first insulating gas having high dielectric properties, e.g. $SF_6$, only the second casing 100 which can be hermetically sealed, and to fill the remaining internal volume of the first casing 1 with air or other suitable insulating gases, such as nitrogen ($N_2$), nobles gases, or mixtures.

Preferably, in the device according to the invention, the second casing 100 is formed by several pieces solidly connected to each other and forming a unique rotating body; in particular, as illustrated in FIGS. 1–2, its structure advantageously comprises the interruption chamber 101 of the circuit breaker unit which in turn can be formed by one or more pieces solidly connected to each other, an electric shield 102 which is preferably mounted close to a first end of the interruption chamber 101, and a hollow rotating supporting member 103. The second casing 100 is operatively connected to the opposite ends of the first casing 1 by means of rotating shaft means shaft 105 and said member 103 which are connected to the casing 1 by using suitable systems, e.g. bearings, flanges etc.

Advantageously, in the switchgear device according to the invention, the second casing 100 is pivotally mounted inside the first casing 1 and is operatively coupled to the actuation means so as, when the disconnection unit is operated by the actuating means, it rotates dragging into rotation at least the first movable contact 9, substantially solidly with it; preferably, in the device according to the invention, also the second movable contact 15 is mounted on the second casing 100, and rigidly rotates with it so as it can be electrically connected/disconnected with/from the fixed contact 14 and the third fixed contact 71 when adopted, during operation of the disconnector unit. For example, the second movable contact 15, as well as the first movable contact 9, can be constituted by a blade which has a profile shaped like a circular sector, with the second and third fixed contacts 14-71 positioned so as to lye on the rotation plane of the second movable contact 15, and the first fixed contact 8 lying in the rotation plane of the corresponding movable contact 9. Likewise, the third movable contact 72 when used can be configured also as a blade with a circular shape sector, which is also mounted on the second casing 100 and rigidly rotates with it.

Further, the actuating means are configured and operatively coupled to the couple of main interruption contacts 10–11 and also to the second casing 100 which in practice acts as and constitutes an actuating means as well-in such a way that, when the second casing 100 rotates during operation of the disconnection unit, the interruption contacts 10–11 remain electrically coupled in the circuit breaker closed position and substantially still relative to each other, i.e. they do not have movement relative to each other (apart from unavoidable mechanical inertia).

Advantageously, in a first embodiment of the device according to the invention, as it will be described in more details hereinafter, the couple of interruption contacts 10 and 11 are operatively coupled to the actuating means so as to rotate, during rotation of the second casing 100, about a reference longitudinal axis 200, substantially simultaneously to each other (apart from unavoidable mechanical inertia), i.e. with the same angular speed, while being electrically coupled in the circuit breaker closed position, and to translate one relative to the other along the longitudinal axis 200 with the casing 100 kept still, during closing/opening operation of said circuit breaker unit. More preferably, the couple of main interruption contacts 10 and 11 are operatively coupled to the actuating means so as to rotate, during rotation of the second casing 100, substantially simultaneously to each other and together with the second casing 100 (apart mechanical inertia). In particular, according to this embodiment, the first main contact 10 is solidly connected to the second casing 100 and the actuation means comprise: rotating shaft means, comprising the rotating shaft 105, which are connected to the second casing 100 and are operatively coupled with driving means positioned outside the first casing 1, schematically indicated in FIG. 1 by the reference number 106; and rod-shaped means which comprise a first rod portion 16, for example made of electrically conducting material, which is connected to and supports the main contact 11, and a second rod portion 17, for example made of electrically insulating material, which protrudes outside the first casing 1 and is operatively connected to driving means 107. The first rod 16 portion and the main contact 11 may be realized in a unique piece made of electrically conducting material.

In turn, the driving means 106 and 107 may comprise a unique motor, for example a rotating electric motor, suitably connected to and alternatively driving the rod means or the shaft-means during operation of the disconnector unit or of the circuit breaker unit, respectively; alternatively, there may be provided two motors each driving separately the rod-shaped means and the shaft means, respectively.

Figure 3:
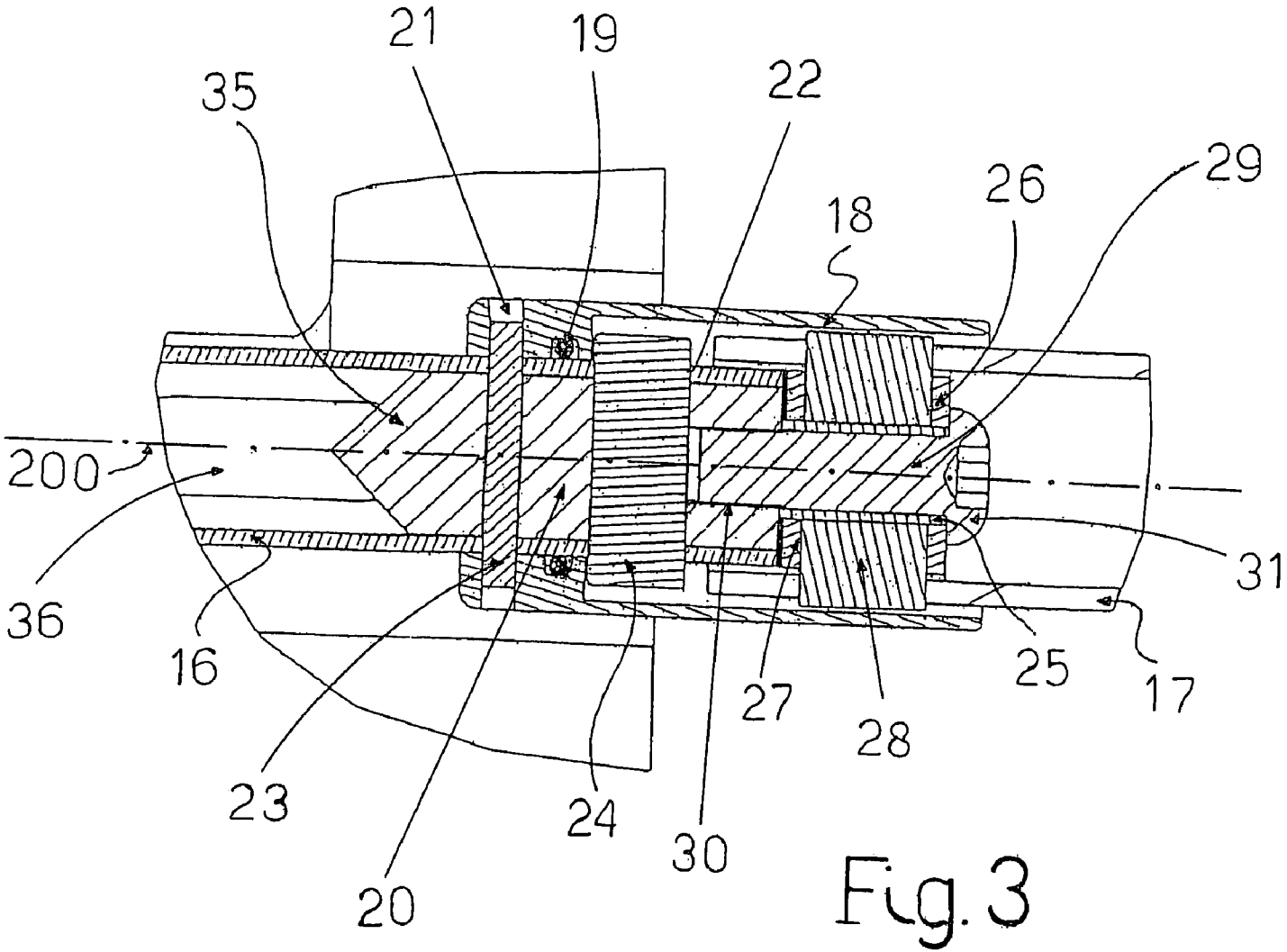
FIG. 3 illustrates in greater details part of the portion circled of FIG. 2.

The two portions 16 and 17 are substantially aligned along the longitudinal axis 200 and are operatively connected to each other and to the second casing 100 by suitable coupling means; as illustrated in FIGS. 2–3 said coupling means comprise a first bush 18 which is positioned around facing ends of the first and second rod portions 16–17, and is connected to a first end of the second casing 100. In particular, the bush element 18 is connected to the internal side of the electric shield 102 by interposing sealing means 19, e.g. a ring made of teflon. The coupling means comprise also a first shaped element 20 which is inserted in the first rod portion 16 at an end thereof, and is provided with a first through hole 21 and a second through hole 22 which are arranged transversally with respect to the longitudinal axis 200; preferably, the shaped element 20 has also a contoured head 35 adapted to obstruct an opening 36 provided on the first rod portion 16. The coupling means further comprise: a first pin 23 which passes inside the first through hole 21 and a corresponding hole of the rod portion 16, and is fitted in a receiving seat provided on the first bush 18; a second pin 24 which passes within the second through hole 22 and is fitted inside a receiving seat provided on the first rod portion 16. The pins 23 and 24 allow realizing rigid couplings among the bush element 18, the first rod portion 16, and the shaped element 20. In addition, there are: a first hollow tube 25 which is positioned, along the longitudinal axis 200, inside the second rod portion 17 and at an end thereof; a second hollow tube 26 which is also positioned inside the second rod portion 17 around the first tube 25, and is provided with a through channel 27 extending transversally with respect to the axis 200; a coupling pin 28 which is inserted inside said through channel 27 and is fitted in a seat arranged on the second rod portion 17; the coupling pin 28 has a through opening, directed along the axis 200, receiving the first hollow tube 25. Finally, there is provided a fixing a element, e.g. a screw 29 which passes through the first tube 25, and has a first end portion 30 which is fixed, e.g. screwed onto the first shaped element 20, and a head portion 31 which, by the fixing, is brought to push the first tube 25 in abutment against the first shaped element 20. Advantageously, the operative coupling between the various components is realized so as, when fixing is completed, there is a suitable small clearance between: the second tube 26 and the first tube 25; the facing surfaces of the second tube 26 and the first shaped element 20-the first rod portion 16; the head portion 31 and the second tube 26.

In practice, in normal working conditions, the circuit breaker unit is in a closed position with the contacts 10–11 electrically coupled; each of the movable contacts of the disconnector unit is connected to the corresponding fixed contact, so as all input/output connections are closed. When it is necessary to execute an electrical maneuver, for example opening the circuit breaker unit due to a fault, the driving means 107 drive the second rod portion 17; the second rod portion 17 translates along the axis 200, (arrow 50 in FIG. 2) and, thanks to the couplings above described, it drags in joint translation with it: the screw 29, the tubes 25–26, the coupling pin 28, the two pins 23–24, the shaped element 20, the bush 18 (which slides on the inner surface of the sealing means 19) the first rod 16, and the second main contact 11 connected to the rod portion 16 which moves away from the first main contact 10; with respect to the second casing 100-first main contact 10-shaft means 105 which instead remain substantially still. At the end of the movement, as illustrated in FIG. 3, the shaped head 35 is advantageously positioned so as to obstruct the opening 36 thus preventing flowing of the hot gases produced following the opening operation towards the insulating second rod portion 17, and convey such gases in a suitable quenching zone inside the casing 100. Closing of the circuit breaker occurs in an analogous way with the same components jointly translating in the opposite direction (arrow 60 in FIG. 2).

When performing operation of the disconnector unit, the drive means 106 drive the shaft means, and in particular the shaft 105 which rotates, around the axis 200, jointly with: the casing 100, the couple of contacts 10–11 (which remain electrically coupled), the sealing means 19, the bush 18, the shaped element 20, the pins 23–24, the first rod portion 16, the screw 30 and the first tube 25; while the second tube 26, the coupling pin 28 and the second rod portion 17 are maintained substantially still. In its rotation, the second casing 100 drags into rotation the movable contact(s) 9(15, 72) of the disconnector unit mounted thereon.

According to an alternative embodiment, the couple of interruption contacts 10 and 11 are operatively coupled to the actuating means so as, during rotation of the second casing 100, they are kept still, i.e. motionless, and electrically coupled in the circuit breaker closed position, while they translate relatively to each other along the axis 200 during opening/closing operations of said circuit breaker unit while the second casing 100 is kept substantially still. According to this embodiment, the first main contact 10 (as well as the arcing contact 12) is mounted on a suitable supporting member, schematically indicated in FIG. 2 by the number 108, which is operatively coupled to the casing 100, e.g. at the zone where the rotating shaft 105 is connected with the casing 100; in turn, the second main contact 11 is connected to rod-shaped means, constituted for example a single rod-shaped body, or comprising two separate rod portions rigidly coupled to each other, e.g. the two rod portions 16–17 of the previous embodiment. In this embodiment, the coupling means are configured so as to mechanically connect the second casing 100 on one side with the main contact 10 and the shaft means, and on the other side with the rod-shaped means by realizing a turning kinematic pair during rotation of the second casing 100, and by realizing a sliding kinematic pair during operation of the circuit breaker unit. In particular, said coupling means may comprise at least a thrust bearing; preferably there are provided two thrust bearings, schematically indicated in FIG. 1 by boxes in dotted lines 80–90, which are positioned for example one inside the electric shield 102 and the other at the opposite end of the first casing 100 at the region where the supporting member 108 is coupled to the casing 100. According to this alternative embodiment, as previously described, when executing opening/closing of the circuit breaker, the driving means 107 drive the rod shaped means which translate along the axis 200 and inside the bearing 90 together with the second main contact 11 which moves away from the first contact 10; the first contact 10 and the casing 100 remain still (sliding kinematic pair with respect to the casing 100). When operating the disconnector unit, the drive means 106 drive the shaft 105 which rotates together with the casing 100 around the axis 200, while, thanks to the thrust bearings 80–90, the contacts 10–11, the supporting member 108 operatively connected to the casing 100 through the bearing 80, and the rod shaped means remain still with the contacts 10–11 electrically coupled in the circuit breaker closed position (turning kinematic pair of the casing 100 with respect to the ensemble contacts 10–11-rod shaped means-shaft means).

In practice, it has been found that the device according to the invention fully achieves the intended aim providing a number of significant advantages and improvements with respect to the prior art devices. Indeed, in the device according to the invention, the second casing 100 advantageously constitutes and acts as an actuating element of the disconnector unit integrating in its structure several components normally provided in the prior art as separate components either structurally and functionally. In addition, thanks to the peculiar couplings realized among the various parts, and in particular among the casing 200, the main interruption contacts 10–11, and the actuating means, during operation of the disconnector unit, the electrical live parts, and above all the main contacts 10–11 themselves, are kept electrically coupled and without relative movement to each other; hence, there is not any substantially friction between the live parts, and especially the main interruption contacts, thus preventing possible damages and avoiding, or at least substantially limiting, production of small residual particles that would otherwise remain within the casing, so becoming inception points and definitely increasing the risk of partial discharges. This definitely results in obtaining several possible configurations according to desired input/output working connections, in a more effective and better coordinated way with respect to known devices. In particular, thanks to the solutions above described, among the various possible combinations which can be realized (e.g. circuit breaker in the closed position with the contacts 10–11 coupled and all movable contacts of the disconnector unit 9, 15 and 72 when adopted-connected to the corresponding fixed contacts 8, 14, and 71), by rotating the casing 100 it is advantageously possible to disconnect only one of the connections (e.g. terminal 6) of the device with external elements such as a power line or other loads and components, while keeping operative the other connections (e.g. terminals 5–72) since the circuit breaker is maintained in the closed position and power is fed. Namely, it is possible to have for example (reference to the preferred embodiment of FIG. 4):

a) circuit breaker in the closed position with the contacts 10–11 coupled, contacts 8–9 of the disconnector unit connected, second movable contact 15 connected to the second fixed contact 14, and third movable contact 72 (if adopted, or the same contact 15 if only two movable contacts of the disconnector unit are used) disconnected from the third fixed contact 71; or alternatively b) circuit breaker in the closed position with the contacts 10–11 coupled, contacts 8–9 of the disconnector unit connected, second movable contact 15 disconnected from the second fixed contact 14, and third movable contact 72 (when adopted, or the same contact 15 if only two movable contacts of the disconnector unit are used) connected to the third fixed contact 71. The switchgear device according to the invention is particularly suitable for use in an electrical substation, preferably of the double bus-bars type; accordingly, the present invention also relates to a high- and/or medium-voltage electric power distribution and/or transmission substation characterized in that it comprises a switchgear device as previously described.

The switchgear device thus conceived is susceptible of modifications and variations, all of which are within the scope of the inventive concept, all the details may further be replaced with other technically equivalent elements. In practice, the materials, so long as they are compatible with the specific use, as well as the individual components, may be any according to the requirements and the state of the art.

The invention claimed is:

1. A gas-insulated switchgear device comprising a first casing housing: at least a first terminal for input/output connection; a disconnector unit comprising at least a first fixed contact operatively coupled to said first terminal and a corresponding first movable contact which can be electrically connected/disconnected with said first fixed contact, during operation of the disconnector unit; a circuit breaker unit electrically connected to said disconnector unit and comprising at least a couple of interruption contacts which can be actuated, during operation of said circuit breaker unit, between a circuit breaker closed position where they are electrically coupled and a circuit breaker open position where they are electrically separated; actuating means for operating said disconnector unit and said circuit breaker unit; a second casing operatively coupled with said actuating means, which houses said interruption contacts and on the outer surface of which at least said first movable contact is mounted; wherein said second casing is pivotally mounted inside said first casing so as to rotate said first movable contact during operation of said disconnector unit, said couple of interruption contacts being operatively coupled to said actuating means so as to be kept electrically coupled in said circuit breaker closed position and substantially prevented from moving relative to each other during rotation of said second casing.

2. A switchgear device according to claim 1, wherein said couple of interruption contacts are operatively coupled to said actuating means so as to rotate, during rotation of the second casing, about a longitudinal axis substantially simultaneously to each other while being electrically coupled in said circuit breaker closed position, and to translate relatively to each other along said longitudinal axis during operation of said circuit breaker unit.

3. A switchgear device according to claim 1 wherein said couple of interruption contacts are operatively coupled to said actuating means so as to rotate, during rotation of the second casing, substantially simultaneously to each other and together with said second casing.

4. A switchgear device according to claim 1, wherein said couple of interruption contacts are operatively coupled to said actuating means so as, during rotation of the second casing, they are kept still with respect to the second casing itself and electrically coupled in said circuit breaker closed position, and to translate relatively to each other along said longitudinal axis during operation of said circuit breaker unit.

5. A switchgear device according to claim 1 wherein said couple of interruption contacts comprises a first main contact and a second main contact and said actuating means comprise shaft means operatively coupled to said first main contact and to driving means, rod-shaped means operatively coupled to said second main contact, and coupling means which mechanically connect the second casing with said shaft means and/or said rod-shaped means by a turning kinematic pair during rotation of the second casing, and by a sliding kinematic pair during operation of the circuit breaker unit.

6. A switchgear device according to claim 5, wherein said coupling means comprise at least a thrust bearing.

7. A switchgear device according to claim 1 wherein said couple of interruption contacts comprises a first main contact and a second main contact and said actuating means comprise: shaft means operatively coupled with driving means and solidly connected to said first main contact and to the second casing; rod-shaped means comprising a first rod portion connected to said second main contact and a second rod portion operatively connected to driving means, said first and second rod portions being substantially aligned along said longitudinal axis; and coupling means which operatively connect said first and second rod portions to each other and to the second case, said coupling means being configured so as to allow joint rotation of the first rod portion-first and second main contacts-shaft means-second casing with respect to the second rod portion, and joint translation of the first and second rod portions-second main contact with respect to the second casing-first main contact-shaft means.

8. A switchgear device according to claim 7 wherein said coupling means comprise: a first bush positioned around adjacent ends of said first and second rod portions, said first bush being rigidly connected to a first end of the second casing; a first shaped element inserted in said first rod portion at an end thereof and provided with a first through hole and a second through hole which are arranged transversally with respect to said longitudinal axis; a first pin passing inside said first through hole and fitted in a receiving seat provided on said first bush; and a second pin positioned within said second through hole and fitted inside a receiving seat provided on said first rod portion.

9. A switchgear device according to claim 8 wherein said first shaped element has a contoured head adapted to obstruct an opening provided on said first rod portion.

10. A switchgear device according to claim 8 wherein said coupling means further comprise a first hollow tube positioned, along said longitudinal axis, inside the second rod portion and at an end thereof; a second hollow tube positioned inside the second rod portion around said first tube, said second tube being provided with a through channel extending transversally with respect to the longitudinal axis; a coupling pin inserted inside said through channel and fitted in a seat arranged on said second rod portion, said coupling pin having a through opening receiving said first hollow tube; and a fixing element passing though said first tube, and having a first end portion fixed to said first shaped element, and a head portion which pushes said first tube in abutment on said first shaped element, a mechanical clearance being defined between the second tube and the first tube and between the second tube and the first shaped element, respectively.

11. A switchgear device according to claim 1 wherein said second casing is formed by several pieces solidly connected to each other and forming a unique rotating body, said several pieces comprising an electric shield which is positioned at said first end of the second casing.

12. A switchgear device according to claim 1 wherein it further comprises at least a second terminal and wherein said disconnector unit comprises a second fixed contact operatively coupled to said second terminal and a corresponding second movable contact which can be electrically connected/disconnected with said second fixed contact, said second movable contact being fixed on said second casing and rigidly rotating with it.

13. A switchgear device according to claim 12 wherein it comprises a third terminal and wherein said disconnector unit comprises a third fixed contact operatively coupled to said third terminal, said second movable contact being arranged so as to electrically connect/disconnect also with said third fixed contact.

14. The switchgear device according to claim 12 wherein it comprises a third terminal and wherein said disconnector unit comprises a third fixed contact operatively coupled to said third terminal and a corresponding third movable contact which can be electrically connected/disconnected with said third fixed contact, said third movable contact being fixed on said second casing and rigidly rotating with it.

15. A switchgear device according to claim 5 wherein said driving means comprise a unique motor alternatively driving said rod-shaped means or said shaft-means during operation of said disconnector unit or of said circuit breaker unit respectively.

16. An electric power distribution and/or transmission substation wherein it comprises a switchgear device according to claim 1.

17. A switchgear device according to claim 7 wherein said driving means comprise a unique motor alternatively driving said rod-shaped means or said shaft-means during operation of said disconnector unit or of said circuit breaker unit respectively.

* * * * *